US005392608A

United States Patent [19]

Lee

[11] Patent Number: 5,392,608

[45] Date of Patent: Feb. 28, 1995

[54] SUBCOOLING METHOD AND APPARATUS

[75] Inventor: Ron C. Lee, Bloomsbury, N.J.

[73] Assignee: The BOC Group, Inc., New Providence, N.J.

[21] Appl. No.: 37,201

[22] Filed: Mar. 26, 1993

[51] Int. Cl.[6] ..... F17C 7/02

[52] U.S. Cl. ..... 62/9; 62/50.1; 62/50.2

[58] Field of Search ..... 62/45.1, 9, 48.1, 48.2, 62/49.1, 49.2, 50.1, 50.2, 50.6

[56] References Cited

U.S. PATENT DOCUMENTS

| | | | |
|---|---|---|---|
| 2,502,184 | 3/1950 | Thayer | 62/49.1 |
| 2,850,882 | 12/1955 | Starnes | 62/52 |
| 2,964,918 | 12/1960 | Hansen et al. | 62/50.1 |
| 2,970,452 | 2/1961 | Beckman et al. | 62/50.2 |
| 3,093,974 | 8/1961 | Templer et al. | 62/51 |
| 3,827,246 | 8/1974 | Moen et al. | 62/50 |
| 3,938,347 | 2/1976 | Riedel et al. | 62/49.2 |
| 4,175,395 | 11/1979 | Prost et al. | 62/52 |
| 4,608,831 | 9/1986 | Gustafson | 62/48.1 |
| 4,716,738 | 1/1988 | Tatge et al. | 62/50.2 X |
| 4,854,128 | 8/1989 | Zeamer | 62/50.1 |
| 4,947,651 | 8/1990 | Neeser et al. | 62/50.4 |
| 4,961,325 | 10/1990 | Halvorson et al. | 62/48.1 |
| 5,127,230 | 7/1992 | Neeser et al. | 62/50.1 X |
| 5,136,852 | 8/1992 | Neeser et al. | 62/50.4 |
| 5,165,246 | 11/1992 | Cipolla et al. | 62/50.2 X |
| 5,228,295 | 7/1993 | Gustafson | 62/50.1 X |
| 5,243,821 | 9/1993 | Schuck et al. | 62/50.6 |

FOREIGN PATENT DOCUMENTS

| | | | |
|---|---|---|---|
| 244994 | 10/1986 | Japan | 62/50.2 |

*Primary Examiner*—Christopher Kilner

*Attorney, Agent, or Firm*—David M. Rosenblum; Larry R. Cassett

[57] ABSTRACT

A method and apparatus for subcooling a liquid composed of a volatile fluid, for instance, a saturated liquid cryogen, in which two chambers are filled with the fluid and are each initially pressurized after filling so that the fluid is converted to a subcooled liquid. The pressurization of the two chambers is maintained as the subcooled liquid is delivered from each of the two chambers. The filling and the delivery of the two chambers is effected in accordance with a cycle in which one chamber is filled and initially pressurized just prior to the completion of the delivery from the other chamber to allow the continual delivery of the subcooled liquid.

9 Claims, 1 Drawing Sheet

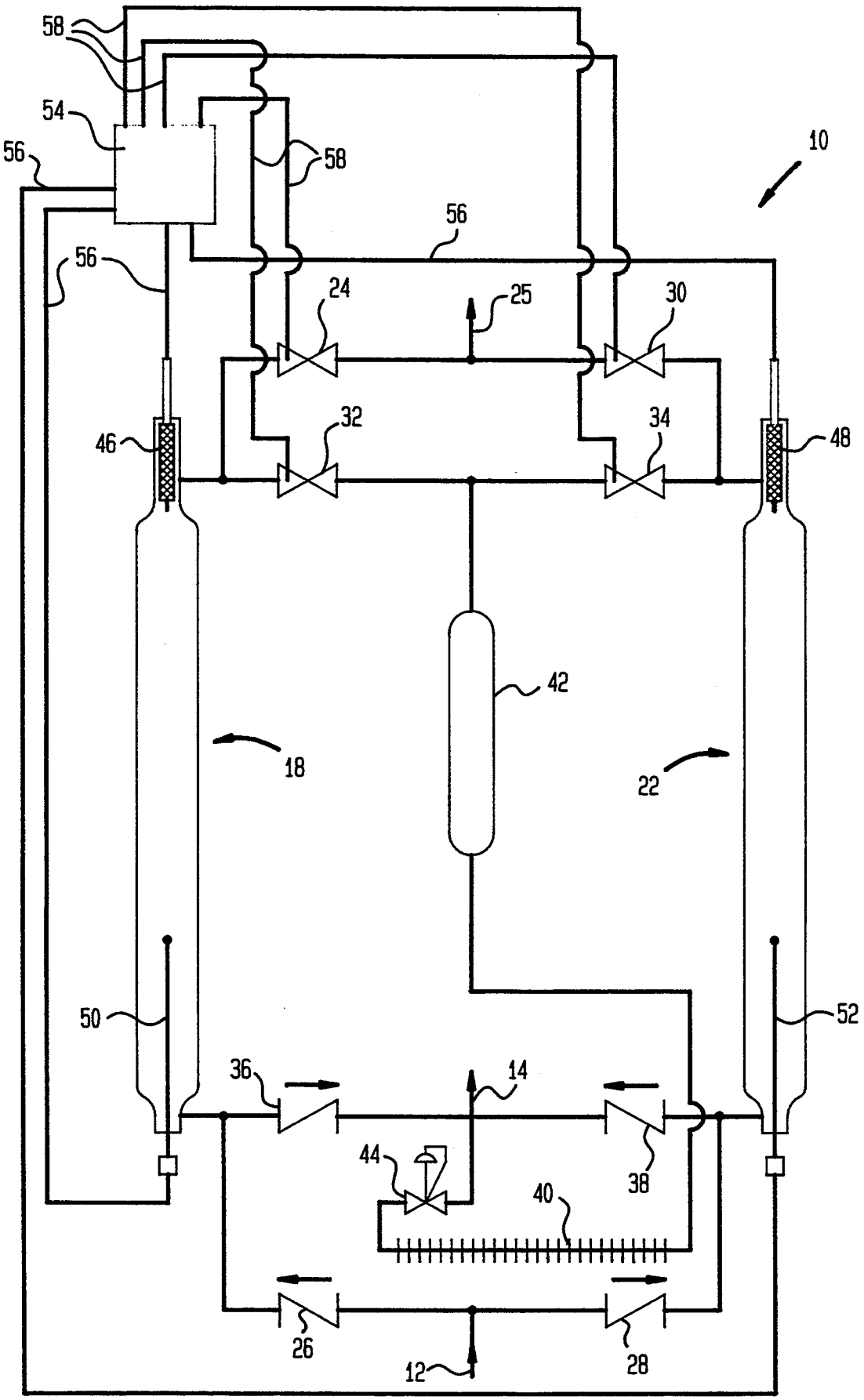
58
54
56
58
10
56
56
24
25
30
32
34
46
48
42
18
22
50
52
36
14
44
38
40
26
12
28

SUBCOOLING METHOD AND APPARATUS

BACKGROUND OF THE INVENTION

The present invention relates to a method and apparatus for producing an uninterrupted flow of a uniformly subcooled liquid composed of a volatile fluid, for instance, a cryogenic liquid. More particularly the present invention relates to such a method and apparatus in which the saturated liquid is converted into a subcooled liquid by pressurization of the volatile fluid.

When a volatile fluid such as a cryogenic liquid is to be delivered from a storage tank or facility by piping, some distance from its origination, it is difficult to prevent the liquid from flashing and vaporizing due to pressure losses and/or heat leak in the piping. In order to prevent such flashing, it is known to lower the temperature of the liquid cryogen below the saturation temperature and to deliver the liquid cryogen in a subcooled state.

Prior art subcoolers, typically for liquid nitrogen, operate by delivering nitrogen as a saturated liquid or two-phase flow nitrogen to the subcooler at an operating pressure. A portion of the incoming flow is diverted and used to fill a reservoir that is maintained at or slightly above atmospheric pressure. The diverted flow is reduced in pressure through expansion to the saturation temperature of nitrogen at atmospheric pressure. The remainder of the nitrogen is routed through heat exchanger coils submerged in the reservoir, and, through heat exchange with the colder reservoir nitrogen, is reduced in temperature so that the nitrogen can be utilized as a subcooled liquid.

A major disadvantage of such a prior art subcooler is that the degree of subcooling achieved is variable depending upon process conditions. Additionally, a relatively large amount of the incoming nitrogen is vented to achieve the subcooling.

The present invention provides a subcooling method and apparatus by which a cryogen or any other volatile fluid can be subcooled in a controlled manner and with significantly reduced losses as compared with prior art subcooling techniques. Other advantages of the present invention will become apparent.

SUMMARY OF THE INVENTION

The present invention provides a subcooling method and apparatus. The basic principle behind the present invention is that a volatile fluid either partially or entirely saturated can be subcooled through an increase in its pressure rather than as in prior art subcoolers, such as described above, through a reduction in temperature.

In accordance with the present invention, a method of converting a volatile fluid into a subcooled liquid and delivering the subcooled liquid is provided. In accordance with this method each of two chambers is filled with the volatile fluid. Each of the two chambers is initially pressurized after having been filled to a pressure sufficient to convert the volatile fluid into the subcooled liquid. After the initial pressurization, the subcooled liquid is delivered from each of the two chambers while maintaining each of the two chambers at the pressure. The filling of and the delivery from the two chambers is alternated in accordance with the cycle such that one of the two chambers fills with the volatile fluid and is initially pressurized prior to completion of the delivery of the subcooled liquid from the other of the two chambers and vice-versa. Additionally, as per the cycle, the subcooled liquid is delivered from the other and then the one of the two chambers and vice-versa without interruption.

In accordance with another aspect of the present invention, an apparatus is provided for converting a volatile fluid into a subcooled liquid and for delivering the subcooled liquid. The apparatus comprises two chambers each configured to receive the volatile fluid and to be pressurized to a pressure sufficient to convert the volatile fluid into the subcooled liquid. An actuable filling means is provided for filling each of the two chambers with the volatile fluid and a delivery means is provided for delivering the subcooled liquid from each of the two chambers. Actuable pressure means is provided for initially pressurizing each of the two chambers, after having been filled with a volatile fluid, to the pressure and for maintaining pressurization within each of the two chambers at the pressure during the delivery of the subcooled liquid. An upper and lower level detecting means is provided for respectively detecting an upper level of the saturated liquid attained at the completion of the filling of each of the two chambers with the volatile fluid and a lower level of the subcooled liquid attained prior to completion of delivery of the subcooled liquid from each of the two chambers. A control means, responsive to the upper and lower level detecting means, is provided for actuating the actuable filling and pressurization means such that the filling of and the delivery from the two chambers is alternated in accordance with the cycle. In the cycle, one of the two chambers fills with the volatile fluid and is initially pressurized prior to completion of the delivery of the subcooled liquid from the other of the two chambers and vice-versa and the subcooled liquid is delivered from the other and then the one of the two chambers and vice-versa without interruption.

The present invention allows a volatile fluid to be converted into a subcooled liquid without major continual losses. As will be discussed, a further advantage is that the present invention permits the volatile fluid to be delivered with a constant, uniform amount of subcooling independent of source tank subcooling, pressure, or delivery flow rate.

It is to be noted here that the term "cryogen" means any highly volatile liquid that by and large exists as a vapor at atmospheric temperatures and pressures, for example, atmospheric gases such as nitrogen, oxygen and argon. As used herein and in the claims a volatile fluid is a fluid that is normally stored at or below its boiling point. A saturated liquid is a liquid having a predetermined pressure and temperature wherein the temperature is the maximum temperature at which the liquid can still exist as a liquid. A subcooled liquid is a liquid having a temperature below its saturation temperature at a given pressure.

BRIEF DESCRIPTION OF THE DRAWINGS

While the specification concludes with claims distinctly pointing out the subject matter that Applicant regards as his invention, it is believed that the invention will be better understood when taken in connection with the accompanying drawing in which the sole figure is a schematic representation of an apparatus in accordance with the present invention.

DETAILED DESCRIPTION OF THE INVENTION

With reference to the figure, an apparatus 10 in accordance with the present invention is illustrated. Apparatus 10 is designed to convert a volatile fluid into a subcooled liquid. The volatile fluid, for instance a liquid cryogen in either a partial or totally saturated state, enters apparatus 10 through a system inlet 12 and is then delivered as a subcooled liquid from a system outlet 14. Although not illustrated, a source of the volatile fluid, for instance a storage tank, would be connected to system inlet 12 of apparatus 10. Additionally, process piping acting as a restriction to flow would be connected to system outlet 14.

The volatile fluid is converted into the subcooled liquid within a pair of chambers 18 and 22. Chambers 18 and 22 are cyrogenic storage tanks which are encased with a sufficient amount of insulation to minimize the degree of heat leakage into the storage tanks. The filling of chambers 18 and 22 with the volatile fluid and the delivery of the subcooled liquid from chambers 18 and 22 are alternated in accordance with a cycle which will be described in more detail hereinafter. However, it is to be noted that chamber 18 fills with the volatile fluid, is initially pressurized with a pressure sufficient to convert the volatile fluid into the subcooled liquid, due to the fact that the act of pressurization does not increase the bulk temperature of the fluid. Chamber 18 is then used to deliver the subcooled liquid just prior to the completion of delivery of the subcooled liquid from chamber 22. Chamber 22 is then filled with the volatile fluid, is initially pressurized to convert the volatile fluid to the subcooled liquid, and then is used to deliver the subcooled liquid just prior to completion of the delivery of the subcooled liquid from chamber 18. The subcooled liquid is thus, alternately delivered from chamber 18 and chamber 22 such that the flow of the subcooled liquid is uninterrupted. In other words, prior to the completion of the delivery from either chamber 18 or chamber 22, delivery of the subcooled liquid is taken up by the other of the chambers which has just been initially pressurized. During the delivery of the subcooled liquid from either of the chambers 18 or 22, the pressure is maintained within chambers 18 and 22 by the use of a pressure building circuit which will also be described in more detail hereinafter.

Preferably, chambers 18 and 22 should be minimally sized to in turn minimize the residence time of the subcooled liquid within the chambers and thereby minimize heat leakage to the subcooled liquid. Additionally, the minimization of chamber size will also decrease the cycle time to also help minimize heat leakage into chambers 18 and 22. The pressurization within the chambers 18 and 22 can be accurately controlled with the pressure building circuit and, given the minimization of heat leakage, the apparatus and method of the present invention allows the delivery of the subcooled liquid with a uniform degree of subcooling and without the stratification that otherwise occurs after a period of time when pressure building circuits of the prior art are utilized in conjunction with storage tanks to subcool volatile fluids stored within such storage tanks. Additionally, since the chambers 18 and 22 are initially vented to atmosphere or perhaps to some other pressure below the storage pressure, the volatile fluid upon filling chambers 18 and 22 will be converted into an essentially uniform saturated state. Thereafter, accurate control of the pressurization of chambers 18 and 22 will thereby ensure a uniform degree of subcooling.

A more detailed discussion of the operation of apparatus 10 begins with the filling of chamber 18. Chamber 18 is filled prior to completion of dispensing of subcooled liquid from chamber 22. The filling of chamber 18 with volatile fluid is initiated with the opening of a valve 24 connected to chamber 18 above an upper level of volatile fluid attained at the completion of the filling of chamber 18 with the volatile fluid. Valve 24 is connected to a system vent 25. System vent 25 vents chamber 18, or chamber 22 for that matter, to atmosphere. The volatile fluid enters system inlet 12 and passes through a check valve 26 which is set so as to prevent the volatile fluid or the subcooled liquid from flowing from chamber 18 back out of system inlet 12. A similar check valve 28 is provided for chamber 22. During the filling of chamber 18 a valve 30 provided to vent chamber 22 is closed and a second pair of valves 32 and 34, which will also be described in more detail hereinafter, are set so that valve 32 is closed and valve 34 is open.

It is to be noted that prior to and during the filling of chamber 18, subcooled liquid is being dispensed from chamber 22 and is flowing out of apparatus 10 through system outlet 14. A check valve 36 is provided for preventing subcooled liquid from flowing to chamber 18 and a similar check valve 38 is provided for preventing subcooled liquid from flowing from chamber 18 to chamber 22. At the same time, a portion of the subcooled liquid flowing from chamber 22 is flowing into a pressure building circuit of a type well known in the art which consists of a vaporizer 40 and a surge tank 42. A pressure regulating valve 44 is provided to control the pressure generated by the pressure building circuit. As illustrated, the pressure building circuit is connected between valves 32 and 34 and check valves 36 and 38. A portion of the subcooled liquid flowing either from tank 18 or 22 (but at this stage of the cycle now being described, from tank 22) is vaporized in vaporizer 40, accumulates in surge tank 42 and pressurizes chamber 22 by virtue of valve 34 being set in an open position.

The use of the traditional cryogenic pressure building circuit is meant to be illustrative of a means to pressurize the chambers. Alternative pressurization means (where a pressurized gas of the same type as the cryogen is supplied) are possible, including a separate storage container of the cryogen at the operating pressure. In this case the separate source of cryogen would be vaporized at the operating pressure and the resulting gas supplied to apparatus 10 directly to tank 42.

After Chamber 18 is filled with the volatile fluid, valve 34 closes, valve 32 opens, and valve 24 closes. The opening of valve 32 causes vaporized subcooled liquid accumulated within surge tank 42 to pressurize chamber 18 and to convert the volatile fluid contained within chamber 18 into the subcooled liquid. After tank 18 is pressurized, valve 30 opens momentarily to release pressure within chamber 22 and ensure the flow of subcooled liquid will be from chamber 18. Thereafter, the subcooled liquid is delivered from chamber 18 and flows through check valve 36 and out of system outlet 14. Valve 38 prevents backflow into chamber 22.

Prior to the completion of the delivery of subcooled liquid from chamber 18, chamber 22 is filled. This is effected by opening valve 30 which vents chamber 22 to the atmosphere. The volatile fluid flows from system inlet 12 through check valve 28 and then into chamber 22 until chamber 22 is filled. During this portion of the cycle valves 24 and 34 are closed and valve 32 is open.

After completion of the filling of chamber 22, valves 30 and 32 close and valve 34 opens so that the volatile fluid contained within chamber 22 is initially pressurized with vaporized saturated liquid produced from tank 18 and accumulated in surge tank 42. After chamber 22 is pressurized, valve 24 opens momentarily to release pressure within chamber 18. The foregoing sequence of events causes subcooled liquid to be delivered from chamber 22.

The operation of the valves and the control of the cyclic operation of apparatus 10 is effected by detecting the levels of the volatile fluid and the subcooled liquid within chambers 18 and 22 by upper level detectors 46 and 48 and lower level detectors 50 and 52, respectively. The upper and lower level detectors are connected to a control circuit 54 by electrical leads 56. Control circuit 54 is either an analog or a programmable logic controller designed and/or programmed in a manner well known in the art to control the operation of valves 24 through 34. Valves 24, 30, 32 and 34 are typically solenoid operated, normally closed valves which are electrically controlled through electrical connections 58.

Upper level detectors 46 and 48 are connected to the top of chambers 18 and 22, above upper levels thereof, so as to be able to detect upper levels of the volatile fluid that are attained when chambers 18 and 22 are filled. They are preferably the type of level detector that is described in U.S. Pat. No. 5,167,154 and which is specifically designed to sense the level of a saturated liquid, for instance liquid nitrogen. It is to be noted that when the liquid nitrogen is introduced into apparatus 10 through system inlet 12, it can be either wholly or partially saturated. Chamber 18 and Chamber 22 fill because they are being vented to a lower pressure than the incoming liquid. A drop in pressure will also convert the cryogen into an essentially saturated state whose level can be sensed by level detectors 46 and 48.

A lower level of the subcooled liquid is sensed by lower level detectors 50 and 52 which are elongated thermocouple probes. As illustrated, ends of thermocouple probes 50 and 52 are set at very specific heights within chambers 18 and 22, that is at a lower level of subcooled liquid that is attained just prior to completion of the delivery of subcooled liquid from either chambers 18 and 22. Level detectors 50 and 52 sense level by sensing the change in temperature from subcooled liquid to saturated gas above the subcooled liquid.

When the level of subcooled liquid is sensed to be at the lower level by lower level detector 52, control circuit 54 commands valve 24 to open. The height of level detector 52 is selected such that chamber 18 can be completely filled prior to chamber 22 becoming empty, and further, so that chamber 18 can be pressurized and begin delivering the subcooled liquid prior to the emptying of chamber 22. Similarly, the sensing of the lower level of lower level detector 50 commands valve 30 to open. Once the upper level of the incoming liquid is sensed by upper level detector 46, control circuit 54 commands valves 24 and 34 to close, valve 32 to open and following pressurization of chamber 18 valve 30 to open momentarily. Similarly, the sensing of the upper level of the incoming liquid by level detector 48 will cause control circuit 54 to command valve 34 to open, valves 32 and 30 to close, and following pressurization of chamber 22 valve 24 to open momentarily.

While the invention has been described in reference to a preferred embodiment, it will be understood by those skilled in the art that numerous additions, omissions, and changes can be made without departing from the spirit and scope of the invention.

It is claimed:

1. A method of convening a volatile fluid into a subcooled liquid for delivering the subcooled liquid:

filling each of two chambers with the volatile fluid;

initially pressurizing each of the two chambers after having been filled to a pressure sufficient to convert the volatile fluid into the subcooled liquid; and after the initial pressurization, delivering the subcooled liquid from each of the two chambers while maintaining each of the two chambers pressure by continually vaporizing a portion of the subcooled liquid contained within the one and the other of the two chambers during delivery of the subcooled liquid;

the filling of and delivery from the two chambers being alternated in accordance with a cycle such that one of the two chambers fills with the volatile fluid and is initially pressurized with subcooled liquid vaporized within the other of the two chambers and vice-versa prior to completion of the delivery of the subcooled liquid from the other of the two chambers and vice-versa, and the subcooled liquid is delivered from the other and then the one of the two chambers and vice-versa without interruption.

2. The method of claim 1, wherein vaporized subcooled liquid is accumulated prior to being used for the initial pressurization of the two chambers.

3. The method of claims 1 or 2 wherein prior to the filling of each of the two chambers, the two chambers are vented to an initial pressure at which the volatile fluid will comprise a saturated liquid.

4. The method of claim 3 wherein:

the volatile fluid is a liquid cryogen;

the portion of the subcooled liquid is vaporized by passing it through a pressure building circuit connected to the two chambers; and the two chambers are vented to atmosphere.

5. An apparatus for converting a volatile fluid into a subcooled liquid and for delivering the subcooled liquid; said apparatus comprising:

two chambers each configured to receive the volatile fluid and to be pressurized to a pressure to a pressure sufficient to convert the volatile fluid into the subcooled liquid;

actuable filling means for filling each of the two chambers with the volatile fluid;

delivery means for delivering the subcooled liquid from each of the two chambers;

upper and lower level detecting means for respectively detecting an upper level of the saturated liquid attained at a pressure building circuit connected to the two chambers anti configured such that a portion of the subcooled liquid contained within each of the two chambers vaporizes to maintain the pressure within each of the two chambers during delivery of the subcooled liquid;

the pressure building circuit having means for accumulating a sufficient quantity of vaporized subcooled liquid to initially pressurize each of the two chambers.

6. The apparatus of claim 5, wherein the actuable filling means comprises:

a system inlet to receive the volatile fluid;

a pair of check valves communicating between the two chambers and the system inlet and set such that subcooled liquid is prevented from flowing from the two chambers back to the system inlet; and a pair of actuable valves actuated by the control means and connected to the chambers for individually venting the one and the other of the two chambers to an initial pressure, lower than that of the volatile fluid, and thereby producing a flow of the volatile fluid from the system inlet to the one and the other of the two chambers being vented.

7. The apparatus of claim 5 wherein the delivery means include a system outlet and a pair of check valves communicating between the two chambers and the system outlet and set such that the subcooled liquid can flow from the one and the other of the two chambers to the system outlet but is prevented from flowing between the two chambers.

8. The apparatus of claim 6, wherein:

the pair of check valves of the actuable filling means comprise a first pair of check valves; and the delivery means include a system outlet and a second pair of check valves communicating between the two chambers and the system outlet and set such that the subcooled liquid can flow from the one and the other of the two chambers to the system outlet but is prevented from flowing between the two chambers.

9. The apparatus of claim 8, wherein:

the pair of actuable valves of the filling means comprise tint pail of valves; and the actuable pressurization means includes:

a second pair of actuable valves actuated by the control system and connected to the two chambers;

the pressure building circuit connected between the second pair of check valves so as to be operable to receive the portion of the subcooled liquid from each of the two chambers and to the second pair of actuable valves; and the second pair of actuable valves configured such that selective actuation of one and the other of the second pair of actuable valves pressurizes the one and the other of the two chambers, respectively, with vaporized subcooled liquid.

* * * * *